US010119229B1

(12) United States Patent
Nitis

(10) Patent No.: US 10,119,229 B1
(45) Date of Patent: Nov. 6, 2018

(54) WORK PLATFORM RAIL SYSTEM

(71) Applicant: Rolling Easy Platforms, LLC, New York, NY (US)

(72) Inventor: Anthony Nitis, Yonkers, NY (US)

(73) Assignee: New Access Solutions, Inc., Brooklyn, NY (US)

( * ) Notice: Subject to any disclaimer, the term of this patent is extended or adjusted under 35 U.S.C. 154(b) by 0 days.

(21) Appl. No.: 15/420,258

(22) Filed: Jan. 31, 2017

Related U.S. Application Data

(63) Continuation of application No. 15/139,722, filed on Apr. 27, 2016.

(60) Provisional application No. 62/153,249, filed on Apr. 27, 2015.

(51) Int. Cl.
*E04G 3/28* (2006.01)
*E01D 19/10* (2006.01)
*E04G 3/22* (2006.01)

(52) U.S. Cl.
CPC ..... *E01D 19/106* (2013.01); *E04G 3/22* (2013.01); *E04G 3/28* (2013.01); *E04G 2003/283* (2013.01)

(58) Field of Classification Search
CPC ..... E04G 3/28; E04G 3/22; E04G 2003/283
See application file for complete search history.

(56) References Cited

U.S. PATENT DOCUMENTS 1,090,253 A 3/1914 Wagner
1,320,740 A * 11/1919 Coghlin ..... B61B 10/025 104/111
1,470,642 A 10/1923 Ready
2,067,344 A 1/1937 Ringe
2,744,472 A 5/1956 Symons
3,601,348 A 8/1971 Gonsalves et al.
3,884,153 A 5/1975 Sugimoto
3,935,822 A * 2/1976 Kaufmann ..... B61C 13/04 104/109
4,570,543 A * 2/1986 Ishikura ..... B61C 13/04 104/247
4,646,647 A 3/1987 Spoler et al.
4,660,680 A * 4/1987 Potin ..... E01D 19/106 182/150
4,848,516 A 7/1989 Nakai et al.
5,011,710 A * 4/1991 Harrison ..... B24C 3/065 182/129
5,299,655 A 4/1994 Margaritis
(Continued)

FOREIGN PATENT DOCUMENTS

EP 0728872 A1 8/1996
EP 0847471 B1 6/2004
(Continued)

*Primary Examiner* — Alvin C Chin-Shue

(57) ABSTRACT

A system and apparatus for constructing a work platform under a bridge deck that has a decking segment that moves under the bridge deck from one end to the other as work progresses, eliminating the need for constructing decking under the entire length of the bridge deck. The decking segment hangs from a plurality of trolleys that move along a plurality of rails beneath the bridge deck, the trolleys moving the decking segment from one end of the bridge deck to another. The trolley has at least one main wheel that runs on the tubular rail top and a plurality of side wheels that maintain the trolley on the tubular rail, the trolley smoothly moving along the tubular rail.

1 Claim, 5 Drawing Sheets

(56) References Cited

U.S. PATENT DOCUMENTS

| | | | |
|---|---|---|---|
| 5,678,654 | A | 10/1997 | Uzawa |
| 5,730,248 | A | 3/1998 | Apostolopoulos |
| 5,921,346 | A | 7/1999 | Apostolopoulos |
| 6,003,634 | A | 12/1999 | Apostolopoulos |
| 6,135,240 | A | 10/2000 | Apostolopoulos |
| 6,138,793 | A | 10/2000 | Apostolopoulos |
| 6,264,002 | B1 | 7/2001 | Apostolopoulos |
| 6,302,237 | B1 | 10/2001 | Apostolopoulos |
| 6,386,319 | B2 | 5/2002 | Apostolopoulos |
| 6,523,644 | B2 | 2/2003 | Apostolopoulos |
| 6,817,444 | B1 | 11/2004 | Shinas |
| 7,941,986 | B2 | 5/2011 | Jolicoeur et al. |
| 8,123,001 | B1 | 2/2012 | Apostolopoulos et al. |
| 2001/0040070 | A1 | 11/2001 | Apostolopoulos |
| 2002/0029932 | A1 | 3/2002 | Apostolopoulos |
| 2002/0092706 | A1 | 7/2002 | Apostolopoulos |
| 2003/0127287 | A1 | 7/2003 | Apostolopoulos |
| 2004/0020138 | A1 | 2/2004 | Grearson |
| 2004/0117928 | A1 | 6/2004 | Apostolopoulos |
| 2008/0250579 | A1 | 10/2008 | Sten et al. |
| 2011/0085854 | A1 | 4/2011 | Apostolopoulos et al. |

FOREIGN PATENT DOCUMENTS

| | | | |
|---|---|---|---|
| EP | 2298998 | A2 | 3/2011 |
| WO | 9705348 | A1 | 2/1997 |
| WO | 0216708 | A1 | 2/2002 |
| WO | 2005096725 | A2 | 10/2005 |
| WO | 2008124753 | A1 | 10/2008 |
| WO | 2013061072 | A1 | 5/2013 |
| WO | 2013122607 | A1 | 8/2013 |

* cited by examiner

WORK PLATFORM RAIL SYSTEM

CROSS-REFERENCE TO RELATED APPLICATIONS

This application is a continuation of the nonprovisional utility application, Ser. No. 15/139,722, filed in the United States Patent Office on Apr. 27, 2016, that is the nonprovisional utility application of the provisional patent application, Ser. No. 62/153,249, filed in the United States Patent Office on Apr. 27, 2015, and claims the priority thereof and is expressly incorporated herein by reference in its entirety.

TECHNICAL FIELD

The present disclosure relates generally to a work platform system. More particularly, the present disclosure relates to a work platform and apparatus that installs and moves on a tubular steel rail system below a bridge deck.

BACKGROUND

Like any steel that is constantly exposed to the elements, the steel of bridges requires periodic maintenance. Some bridges have decks that rest on steel beams and struts. Suspension bridges are a type of bridge in which the load-bearing portion called the deck is hung below main suspension cables, which are made from steel rope.

Maintenance workers use decking to create work platforms that allow the workers to walk freely along and under bridge structures. The work platforms additionally capture any debris or stray maintenance materials from falling down, keeping hazardous materials out of bodies of water, off of vehicles and people below.

Installing the decking to create a work platform is time-consuming and must be done with great care to prevent any accidents caused by the platform collapsing. Workers rely on the work platform to be safe and secure as they perform their maintenance high up over dangerous conditions.

Generally, decking extends from a first end of a bridge to a second end of bridge, traversing the entire length of the bridge. Depending on the length of the bridge, the decking may extend just between a long segment which is supported by two piers of a very long bridge. The decking must be fully installed from one end to the other end of the bridge deck before it can be used, which is costly and time-consuming.

While these methods and structures may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system that eliminates the need for constructing decking under the entire length of a bridge deck before beginning work. Accordingly, an aspect of an example embodiment in the present disclosure provides a decking segment that moves under the bridge deck from one end to the other as work progresses and the work area changes.

Another aspect of an example embodiment in the present disclosure is to provide a system with a decking segment that moves under the bridge deck smoothly. Accordingly, the present disclosure provides a decking segment hanging from a plurality of trolleys that move along at least one rail beneath the bridge deck, operative for moving the decking segment from one end of the bridge deck to another as the work progresses and the work area changes.

A further aspect of an example embodiment in the present disclosure is to provide an apparatus that smoothly moves beneath the bridge deck, supporting decking segments that partially cover an area under the bridge deck. According, the present disclosure provides a trolley having at least one main wheel that runs on a tubular steel rail connecting to a support on an "I" bean and a plurality of side wheels that maintain the trolley on the tubular rail, the trolley smoothly moving along the tubular rail with platform decking hanging from the trolley below, moving the decking forward or backward to provide protection to a new area under the bridge deck.

The present disclosure describes a system and apparatus for constructing a work platform under a bridge deck that has a decking segment that moves under the bridge deck from one end to the other as work progresses, eliminating the need for constructing decking under the entire length of a bridge deck. The decking segment hangs from a plurality of trolleys that move along a tubular steel rail beneath the bridge deck, the trolleys moving the decking segment from one end of the bridge deck to another. The trolley has at least one main wheel that runs on the tubular rail top and a plurality of side wheels that maintain the trolley on the tubular rail, the trolley smoothly moving along the tubular rail.

The present disclosure addresses at least one of the foregoing disadvantages presented hereinabove. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
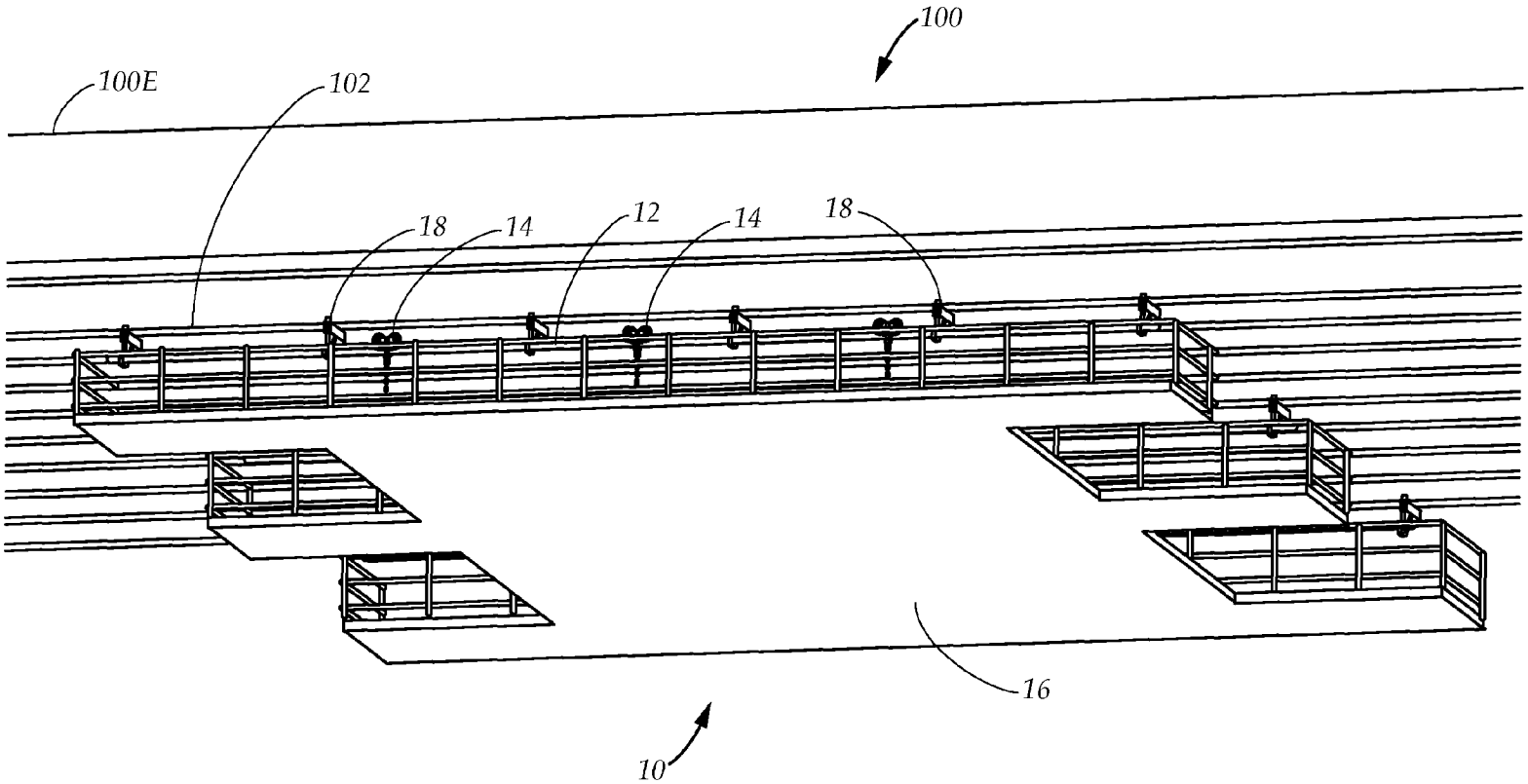
FIG. 1 is a perspective view of an example embodiment of a work platform rail system below a bridge deck.

FIG. 1 illustrates a work platform rail system 10 for providing a work platform for working under a bridge deck 100. The system has an open decking segment 16 and a plurality of apparatuses. An apparatus comprises a tubular rail 12, a trolley 14 and a support 18. The tubular rail 12 is suspended below the bridge deck 100 from a plurality of supports 18, allowing sufficient clearance for a trolley 14 to move freely on the tubular rail 12 under the bridge deck 100. In one example embodiment the tubular rail 12 is hollow, preferably made from steel.

Installing the work platform rail system 10 with the decking segment provides great economic advantages. Work on the bridge deck 100 infrastructure can begin almost immediately without waiting for decking to be installed the length of the bridge deck 100. Fewer decking segments are used because only one segment of decking is required.

In one example embodiment, the tubular rail 12 extends from a first end of the bridge deck 100E to a second end of the bridge deck. The tubular rail 12 can be a unitary piece or connected pieces. The supports 18 and rail 12 remain in place and the trolleys 14 mount on the tubular rail 12 and open decking segment 16 hang from the trolleys as needed.

The decking segment 16 does not extend an entire length of the bridge deck 100, but is a portion of the length, and is sufficiently large to accommodate a work crew, tools and equipment necessary to perform the task. Workers begin working at the first end of the bridge deck 100E and the trolleys 14 move the decking segment 16 along the tubular steel rail 12. As the trolley 14 moves the decking segment 16 towards the second end of the bridge deck, the decking segment 16 is not in contact with the first end of the bridge deck 100E. By moving the decking segment 16 in conjunction with the work in progress and as a work area changes, the necessity of constructing multiple decking segments the entire length of the bridge deck 100 is eliminated.

Figure 2:
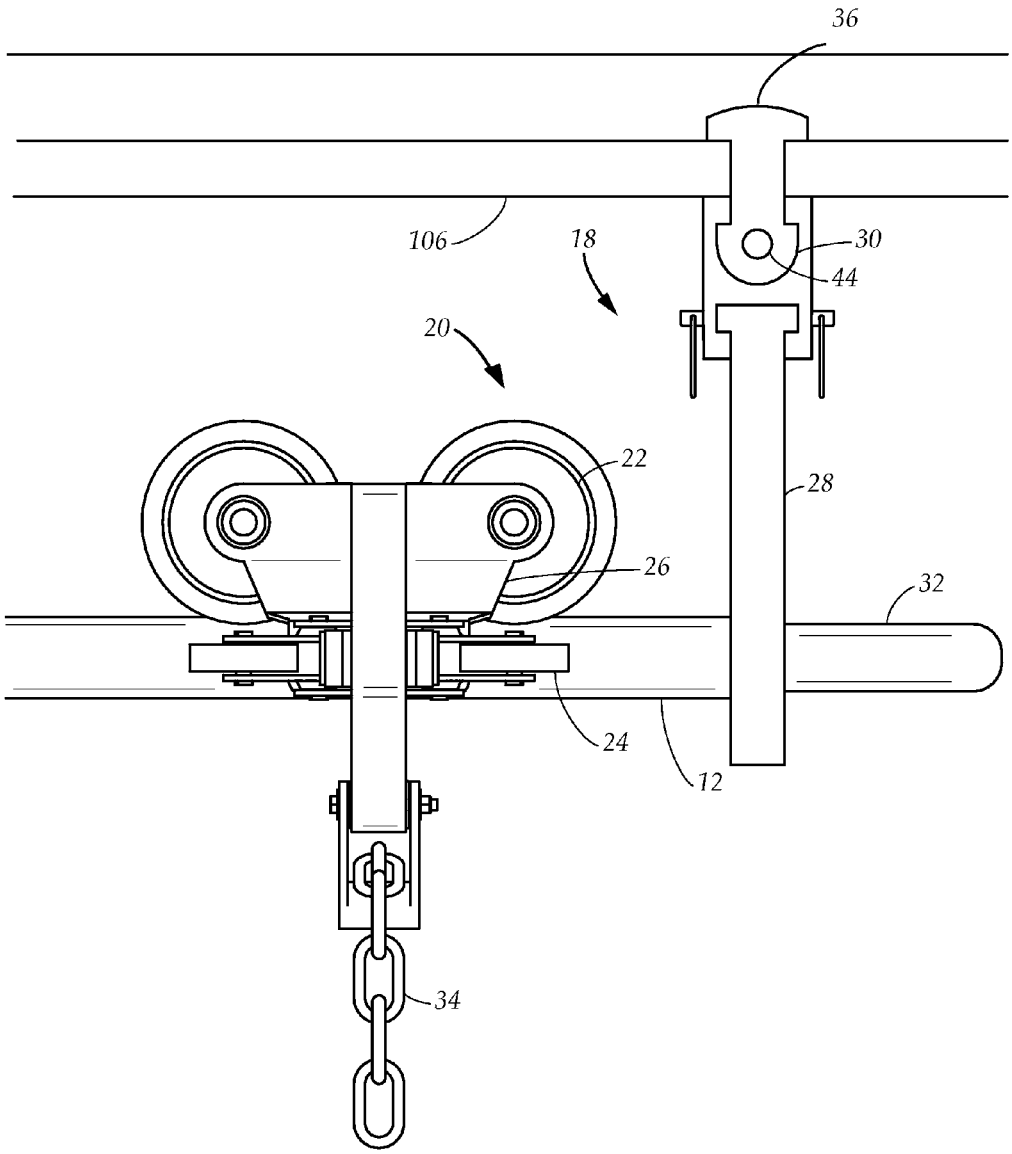
FIG. 2 is a side elevational view of an example embodiment of an apparatus in the work platform system.
Figure 5:
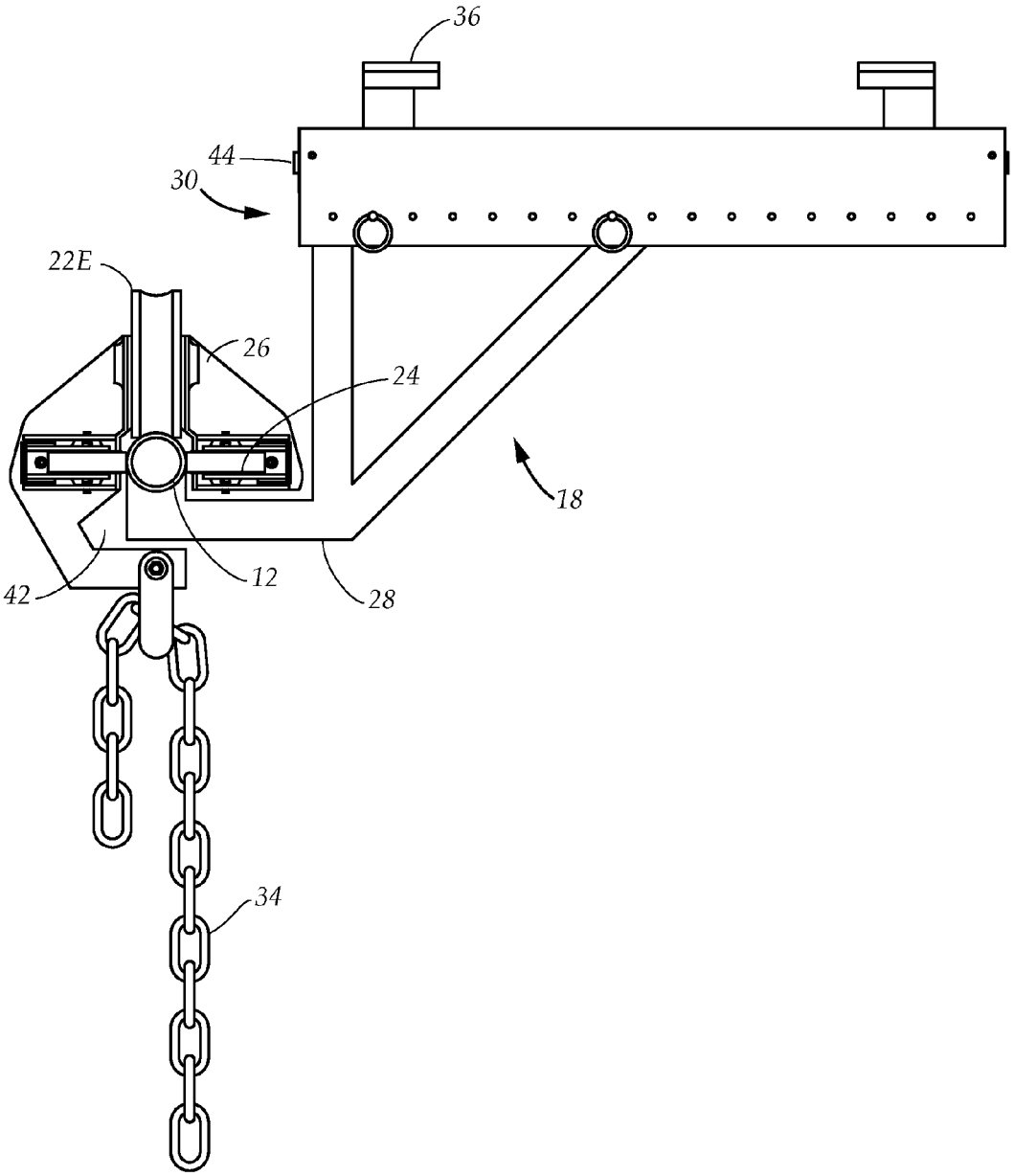
FIG. 5 is a front elevational view of the apparatus in the work platform rail system.

FIG. 2 and FIG. 5 illustrate an apparatus 20 of the system. The apparatus 20 comprises the trolley 14 having a group of wheels configured for moving along the tubular rail 12. The apparatus 20 includes a support 18 configured for suspending the tubular rail 12 from a structural support below a bridge deck. The trolley 14 moves along the tubular rail 12, moving the decking segment as a work area under the bridge deck changes.

The trolley 14 has at least one main wheel 22, preferably two, configured for moving along a tubular rail 12 top surface. In some example embodiments, the at least one main wheel 22 is a double-flanged wheel, having a flange 22E on each edge, conforming to the tubular rail 12 top surface.

In some example embodiments, the trolley 14 has a pair of side wheels 24, the side wheels 24 on opposing sides of the tubular rail 12, the wheels configured for stabilizing the trolley on the tubular rail 12 as the at least one main wheel 22 moves the trolley 14 in a horizontal direction. The trolley 14 is motorized, having a motor within the motor housing 26, powering the at least one main wheel. The motor can be, but not limited to, electric, pneumatic, hydraulic or hybrid and the type of motor is not a limitation.

This is just one configuration possible of the wheels, and other configurations are possible. The number of wheels is not a limitation and a trolley 14 can have a plurality of main wheels and side wheels, depending on the load.

In some example embodiments, the trolley 14 has a chain shackle 34 configured for hanging a decking segment.

In some example embodiments, the support 18 has flange clamp 30 configured for grasping a pair of bottom flanges 106 of the "I" beam. The flange clamp 30 has a pair of adjustable clamp jaws 36 configured for grasping the "I" beam. The adjustable clamp jaws 36 are tightened or loosed using an adjustment screw 44. In some example embodiments, the support has a "Y" shaped support arm 28 extending down and outward from the "I" beam. The tubular rail 12 is supported by the support arm 28.

It is understood that the illustration shows the support configured for grasping an "I" beam, but the support attachment means can be modified to grasp any structural support such as a beam or column used in the construction of bridges and buildings. Use of the apparatus on both vertical and horizontal means are also within the inventive concept.

In some example embodiments, the trolley 14 has an opening 42 configured for accommodating the support arm 28 of the support 18, such that the trolley 14 moves smoothly along the tubular rail 12 past the support 18.

Figure 3:
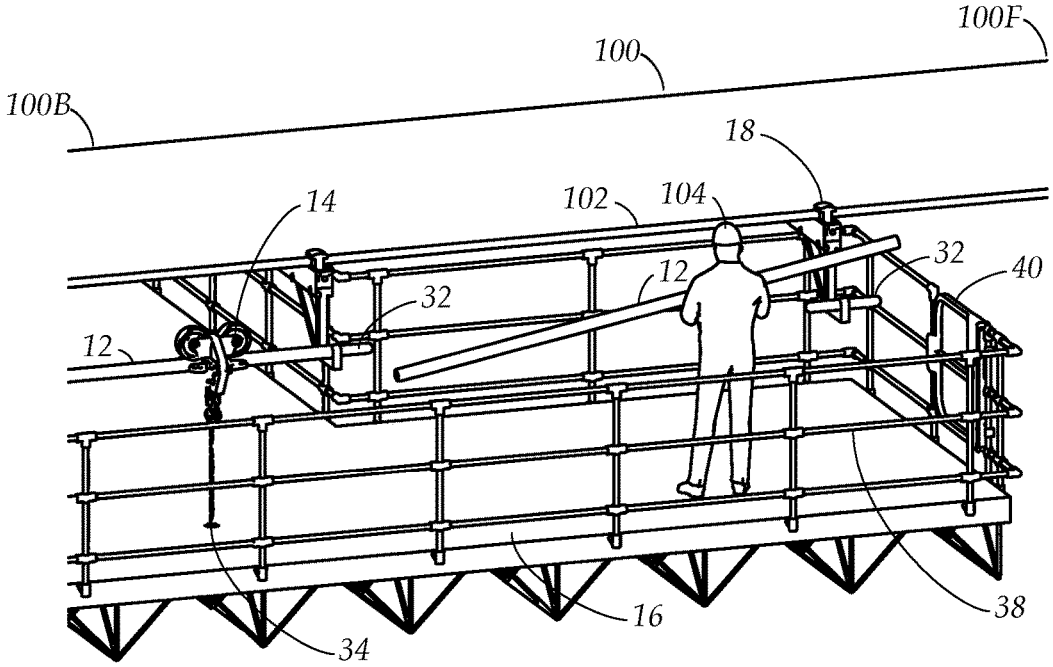
FIG. 3 is a perspective view of a worker installing a decking segment using the work platform rail system.

FIG. 3 shows a further example embodiment of the system 10. In this example embodiment having multiple apparatuses, the supports 18 and tubular rails 12 are configured to be assembled as the deck segment 16 moves from one end of the bridge deck to another. The tubular rail 12 is in short segments and is hollow. The short segments of tubular rail 12 linearly connect by a connecting pin 32 inserted in the hollow ends of the tubular rails, uniting the two pieces of tubular rail 12.

The connecting pin 32 connects the tubular rail 12 of a first apparatus to the tubular rail 12 of a second apparatus, connecting the tubular rails thereby extending the work platform system in a direction so the trolleys 14 can move the decking segment in said direction.

A method of installing the work platform rail system as illustrated in FIGS. 1-3 and 5 comprises the steps of installing the supports 18 on the "I" beam, suspending the tubular rails 12 from the supports, and connecting rails with the connecting pin 32. Placing the at least one main wheel of a trolley 14 on the linearly connecting rails is followed by shackling the deck segment by a chain shackle 34.

In one example embodiment, the supports 18 and rails 12 are permanently installed. In another example embodiment, the supports are moved along the "I" beam 102 as needed, the supports 18 are moved from the backend 100B and moved to the frontend 100F as the decking segment 16 moves under the bridge deck 100. The tubular rails 12 are suspended from the supports 18, the tubular rail 12 moving from the backend 100B to the frontend 100F and connected by a connecting pin 32. The trolleys 14, once installed, move seamlessly and smoothly along the tubular rails 12, the decking segment 16 hanging from the trolleys 14. In one example embodiment, the motors of the trolleys 14 are controlled by a master switch, such that all trolleys move at the same time in the same direction. In some example embodiments, the motors are synchronized to operate together by a wireless controller.

In one example embodiment of the method, the support 18 includes a flange clamp 30 that attaches the support 18 to the "I" beam bottom flange 106. The support 18 is installed by opening a pair of adjustable clamp jaws 36 configured for grasping a pair of bottom flanges 106 of the "I" beam 102, closing the clamp jaws 36 tightly using the adjustment screw 44 until the flange clamp 30 is secure. The "Y" shaped support arm 28 extends down and outward from flange clamp 30, the arm configured for supporting the tubular rail 12. The tubular rail 12 is then suspended from the arm 18.

The decking segment 16 is sufficiently open so that workers 104 can walk back and forth along its length, moving freely about. The decking segment 16 includes a perimeter safety railing 38 and a safety gate 40.

The number of apparatuses 20 is not a limitation and the number of apparatuses depends on the length and width of the decking segment 16 and the anticipated loading on the decking segment.

Figure 4:
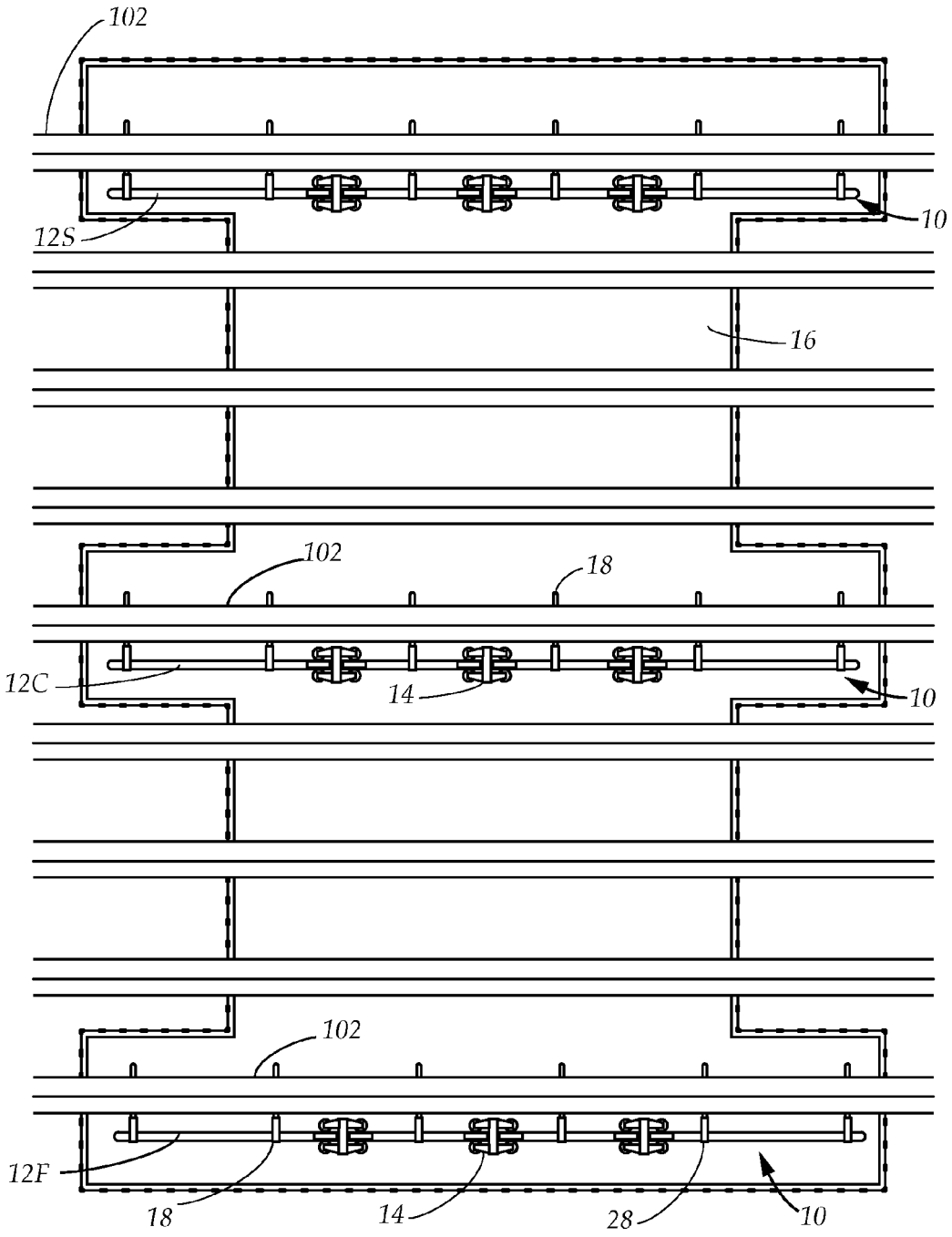
FIG. 4 is a top plan view of the work platform rail system with the bridge deck removed from the figure for illustrative purposes.

FIG. 4 shows the work platform rail system 10 installed under the bridge deck, with the bridge deck not shown to better illustrate the system. In some example embodiments as shown in FIG. 4, a first tubular rail 12F is suspended from a first "I" beam 102 below the bridge deck near a first side of the bridge deck and a second tubular rail 12S is suspended from a second "I" beam 102 below the bridge deck near a second side of the bridge deck. The decking segment 16 hangs from the trolleys 14. The support arms 28 of the supports 18 suspend the tubular rail 12 and the tubular rail 12S.

In some example embodiments, at least one rail 12C is suspended from "I" beams below the bridge deck towards the bridge deck center. It is understood that a number of apparatuses may be installed on the multiple "I" beams as necessary to support the decking segment 16, depending upon the width of the bridge deck and the load on the decking segment and the number is not a limitation of the system.

FIG. 4 shows a plurality of trolleys 14 on each rail 12 and number of trolleys is not a limitation and the number is based on the load and size of the decking segment.

The work platform rail system 10 for providing decking that moves under a bridge deck as a work area changes may include a group of apparatuses that include a group of rails 12, each rail suspended from a "I" beam 102 below a bridge deck; a group of trolley 14, each configured to move along the tubular rails; a decking segment 16 hanging from the trolley 14, the decking segment 16 moving under the bridge deck as the trolley 14 move along the tubular rails 12, the decking segment 16 providing a safe work platform as a work area changes.

Other configurations of the work platform rail system are possible within the inventive concept to accommodate extremely large loads. In some example embodiments, a pair of linearly connected tubular rails are placed in parallel and are braced together by struts. Other components of the apparatus are modified to accommodate this configuration.

In the illustration, the decking segment 16 is shown in a double "H" configuration. It is understood by those of ordinary skill in the art other decking segments configurations are possible within the inventive concept and that this illustrated configuration is not a limitation.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a work platform rail system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method of installing a movable work platform rail system for working under a bridge decking, comprising:

installing a plurality of supports on a pluraliy of parallel "I" beams, the supports each having a flange clamp with a pair of adjustable clamp jaws, the clamp jaws grasping a pair of bottom flanges of a respective "I" beam, each support having a "Y" shaped arm extending down and outward from said flange clamp;

suspending a plurality of tubular rails from the "Y" shaped arm of the supports and connecting the tubular rails with a plurality of connecting pins, each tubular rail having a backend and a frontend, the frontend of one connecting to the backend of another, forming a plurality of linearly connected tubular rails that are suspended in parallel from the supports;

placing a plurality of motorized trolleys on the parallel linearly connected tubular rails by placing at least one main wheel of each motorized trolley on top of a respective one of the linearly connecting tubular rails and further positioning a pair of side wheels of each motorized trolley on opposing sides of the respective linearly connected tubular rail at least one motorized trolley on each linearly connected tubular rails;

shackling a decking segment to the motorized trolleys, the decking segment having a pair of opposite sides, a first side shackling to respective motorized trolleys on a first linearly connected tubular rail of said lineraly connected rails and a second side shackling to a second linearly connected tubular rail of said lineraly connected rails, parallel to the first linearly connected tubular rail; and moving the decking segment along the linearly connected tubular rails under a bridge decking as work progresses, the motorized trolleys traveling over the linearly connected tubular rails, wherein the step of moving the decking segment under the bridge decking is followed by the step of: removing a first tubular rail of each linearly connected tubular rail from the supports and leaving a second tubular rail of each linearly connected tubular rail in place; and re-suspending the first tubular rails by connecting the backend of each first tubular rail to the frontend of each second tubular rail, connecting the first tubular rails and second tubular rails by pins such that the motorized trolleys move the decking segment over the first re-suspended tubular rails from the second tubular rails.

* * * * *